US009937539B2

(12) United States Patent
Merz et al.

(10) Patent No.: US 9,937,539 B2
(45) Date of Patent: Apr. 10, 2018

(54) METHOD AND DEVICE FOR PRODUCING A METAL STRIP IN A CONTINUOUS CASTING AND ROLLING PROCESS

(71) Applicant: SMS Group GmbH, Duesseldorf (DE)

(72) Inventors: Juergen Merz, Kreuztal (DE); Heinz-Adolf Mueller, Wilnsdorf (DE)

(73) Assignee: SMS GROUP GMBH, Duesseldorf (DE)

( * ) Notice: Subject to any disclaimer, the term of this patent is extended or adjusted under 35 U.S.C. 154(b) by 128 days.

(21) Appl. No.: 15/109,176

(22) PCT Filed: Dec. 23, 2014

(86) PCT No.: PCT/EP2014/079262

§ 371 (c)(1),
(2) Date: Jun. 30, 2016

(87) PCT Pub. No.: WO2015/101577

PCT Pub. Date: Jul. 9, 2015

(65) Prior Publication Data

US 2016/0325324 A1 Nov. 10, 2016

(30) Foreign Application Priority Data

Jan. 3, 2014 (DE) ..... 10 2014 200 021
Nov. 27, 2014 (DE) ..... 10 2014 224 231

(51) Int. Cl.
*B21B 1/26* (2006.01)
*B21C 47/26* (2006.01)
(Continued)

(52) U.S. Cl.
CPC ..... *B21B 1/26* (2013.01); *B21B 1/463* (2013.01); *B21B 41/08* (2013.01); *B21C 47/267* (2013.01);
(Continued)

(58) Field of Classification Search
CPC ..... B21B 1/26; B21B 1/463; B21B 41/08; B21B 2015/0014; B21B 39/006;
(Continued)

(56) References Cited

U.S. PATENT DOCUMENTS 5,542,165 A 8/1996 Coassin
6,450,437 B1 9/2002 Figge
(Continued)

FOREIGN PATENT DOCUMENTS

JP 63157750 6/1988
JP 01224102 9/1989
(Continued)

*Primary Examiner* — Ryan J Walters
(74) *Attorney, Agent, or Firm* — Abelman, Frayne & Schwab

(57) ABSTRACT

The invention relates to a method for producing a metal strip (1) in a continuous casting and rolling process, in which a slab is first cast in a casting machine and is then fed to a finishing rolling mill situated downstream in the direction of feed (F) of the strip (1), where it is rolled. According to the invention, in order to enable the recycling of scrap while achieving a compact design, the following steps are performed in the event of a planned or unplanned production interruption in the finishing rolling mill: a) cutting through the strip (1) at a point (4) between the casting machine (2) and the finishing rolling mill by means of a cutting device (5); b) feeding the part of the strip (1) that follows the cut into a strip store (6) by means of a driver (7), the driver (7) being situated downstream of the cutting device (5) in the direction of feed (F); c) cutting through the strip (1) a second time by means of the cutting device (5) and cutting the following part of the strip (1) into pieces by means of the cutting device (5); d) cutting the stored strip section into pieces, preferably of a defined length. The invention further relates to an apparatus for carrying out the method.

12 Claims, 2 Drawing Sheets

(51) Int. Cl.

| | |
|---|---|
| ***B21C 47/34*** | (2006.01) |
| ***B21B 1/46*** | (2006.01) |
| ***B21B 41/08*** | (2006.01) |
| ***B22D 11/126*** | (2006.01) |
| *B21B 39/00* | (2006.01) |
| *B21B 15/00* | (2006.01) |
| *B22D 11/12* | (2006.01) |

(52) U.S. Cl.
CPC ..... *B21C 47/3441* (2013.01); *B22D 11/126* (2013.01); *B21B 39/006* (2013.01); *B21B 2015/0014* (2013.01); *B22D 11/1206* (2013.01)

(58) Field of Classification Search
CPC . B22D 11/126; B22D 11/1206; B21C 47/267; B21C 47/3441
See application file for complete search history.

(56) References Cited

U.S. PATENT DOCUMENTS

| | | | | |
|---|---|---|---|---|
| 7,954,539 | B2 | 6/2011 | Benedetti | |
| 8,453,711 | B2 | 6/2013 | Hohenbichler | |
| 9,186,711 | B2 * | 11/2015 | Benedetti | B21B 1/466 |
| 2010/0116456 | A1 * | 5/2010 | Benedetti | B21B 1/463<br>164/454 |

FOREIGN PATENT DOCUMENTS

| | | |
|---|---|---|
| JP | 05277539 | 10/1993 |
| JP | 2001276910 | 10/2001 |
| KR | 4220424 | 12/1993 |
| KR | 20130053110 | 5/2013 |
| KR | 20130053111 | 5/2013 |
| RU | 2173227 | 9/2001 |

* cited by examiner

METHOD AND DEVICE FOR PRODUCING A METAL STRIP IN A CONTINUOUS CASTING AND ROLLING PROCESS

RELATED APPLICATIONS

This application is a National Stage Application of International Application PCT/EP2014/079262 filed Dec. 23, 2014 and claiming priorities of German applications DE 10 2014 200021.1 filed Jan. 3, 2014 and DE 10 2014 224231.2 filed Nov. 27, 2014, all three applications are incorporated herein by reference thereto.

FIELD OF THE INVENTION

The invention relates to a method for producing a metal strip in a continuous casting and rolling process, in which a slab is first cast in a casting machine and is then fed to a finishing rolling mill situated downstream in the direction of feed of the strip, where it is rolled. The invention further relates to an apparatus for carrying out the method.

The present invention is thus used in casting and rolling mills in which molten metal is used to produce a finished strip in a continuous operation. For mills of this type, a strategy is proposed which may be used when the rolling operation in the finishing rolling mill is either intentionally or unintentionally interrupted.

BACKGROUND OF THE INVENTION

Known casting and rolling trains convert molten steel to hot-rolled strip in a compact system. In this process, first slabs of continuous length are cast.

These slabs are cut with shears into sections, the dimensions of which correspond to a desired size of hot-rolled strip. In reheating furnaces, often designed as roller hearth furnaces, the temperature of the slabs is conditioned. The slabs are then fed separately to a rolling train, where they are rolled into strips. The strips are then cooled in a cooling zone and wound onto reels. The bundles are taken from the rolling line for further processing.

In the so-called semi-continuous process, the slabs are cut in such a way that two or more bundles can be produced from each slab. Downstream of the rolling mill, a flying shear is additionally provided for cutting the long hot-rolled strip into sections to achieve the desired bundle size. In this method, the number of critical threading-in and threading-out processes during rolling is reduced, enabling thinner hot-rolled strips to be produced more safely.

In each of these two process forms, the separation, in particular cutting, of the slabs enables the casting process and the rolling process to be carried out separately. This enables the potential and necessary processing speeds of casting machine and rolling train to be adjusted independently of one another.

Thanks to recent advances in casting machines and in process control, for example the use of heating units, it is now possible to dispense with the step of cutting the slabs into sections prior to rolling. A so-called fully continuous process has been developed. In this process, once the slab is fully solidified, it enters the rolling train without being cut into sections, while at the same time, casting on the same cast strand continues in the casting machine. The material is not separated into bundles until it reaches the flying shear downstream of the rolling train.

Thus in said fully continuous process, operating states regularly occur in which the material extending from the casting machine up to the reel is still connected as a single physical body. The entire process therefore takes place continuously or endlessly.

In mills of this size, malfunctions occasionally occur that may extend over several hundred meters. And when malfunctions occur in the hot strip rolling train, with the shears, etc., for example, the production process must be interrupted. The mill is then shut off and all movement of the strip or the slab is brought to a halt. In such cases, a strand that has not been cut into sections and has undergone different degrees of processing may extend across the entire length of the mill Since the strand is located in the various units (casting machine, shears, furnaces, rolling train, reel) over a length of 100 m or more, movement in the various regions independently of one another is impossible.

In principle, malfunctions may occur in any of the subunits, i.e. in the areas of reeling, the flying shear(s), the finishing train, the roller hearth furnace, etc. A rolling malfunction in the finishing train caused by a strip crack between the last two stands, for example, can result extremely quickly in a material backup between these two stands that can be corrected only by manual intervention. This necessitates time-consuming work followed by inspection and in some cases repair of the mill components.

In the event of a malfunction, the mill controller or the automation system will stop the rolling process. In most cases the stands are opened up as quickly as possible, all drives are shut down and the train comes to a halt. Since the slab is still uncut up to the mold, in some cases the casting machine must also be stopped.

The casting machine as a unit is particularly critical in this context. If the stoppage continues for too long, the steel in the mold will solidify, and removing it from the mold will be highly costly and/or will result in damage to the mold. Uncontrolled opening up of the mold and the strand guide will usually result in strand breakout, causing the molten steel to pour over the unit and resulting in serious damage. And strand guiding rollers in particular are sensitive to thermal overload during prolonged idle periods.

Removing the solidified cast strand from the casting machine is highly time consuming and frequently is possible only by cutting (z. B. flame cutting) the strand manually. This requires crane work and replacement of the mold and in some cases parts of the continuous casting system. This leads to long periods of downtime and production losses, and also entails manual operations.

EP 2 259 886 B1 proposes making a cut in the strip, raising the tail of the strip that is leading in the feed direction, and cutting the subsequent strip into pieces. However this concept assumes that the subsequent strip material is still in motion. Additional or similar solutions as well as specific aspects of cutting the slab or the strip into sections are described in EP 0 625 383 B1, in DE 198 56 767 A1, in DE 42 20 424 A1, in JP 0122 4102 A, in JP 0527 7539 A, in JP 6315 7750 A and in JP 2001 276 910 A.

SUMMARY OF THE INVENTION

The object of the above is to prevent production interruption during continuous casting operations in a continuous system wherever possible, even during a planned roll change. The strand is severed and the severed strip is rolled out. The strand is then cut into sheets, and these are carried away as scrap by a discharge device.

The scrap that is collected downstream of the shear (see the aforementioned EP 2 259 886 B 1) cannot be returned directly to the furnace. Instead, the scrap must be cut up in an intermediate step. If a malfunction occurs in the system, the shears cannot cut backwards. Moreover, no scrap chute is provided.

The object of the invention is to return the production line to its regular operating condition safely, quickly and economically, and preferably partially or fully automatically, following a planned (for example, due to a roll change) or unplanned interruption in production in the finishing rolling train. Steel from the mold and from the casting machine, or the slabs produced therein, or the strip cast therefrom are to be removed as quickly as possible to minimize damage and downtimes. In this process, the material removed from the mill (i e , the scrap) is to be prepared so as to maximally facilitate further processing (i.e., melting); the goal is thus to enable scrap to be recycled in a simple manner. In addition, a compact mill configuration is sought. It is a further goal to produce small pieces of scrap in a simple manner, which can then be returned directly to the melting process.

The attainment of this object by the invention is characterized in that the following steps are performed in the event of a planned or unplanned production interruption in the finishing rolling mill:

a) cutting through the strip at a point between the casting machine and the finishing rolling mill by means of a cutting device;
b) feeding the part of the strip that is downstream of the cut in the direction of feed into a strip store by means of a driver, the driver being situated downstream of the cutting device in the direction of feed;
c) cutting through the strip a second time by means of the cutting device, and cutting the part of the strip that is following in the direction of feed into pieces, preferably of a defined length, by means of the cutting device;
d) cutting the stored strip section into pieces, preferably of a defined length.

In the above step d), the strip located in the strip store is preferably returned by means of the driver in the direction opposite the feed direction to the cutting device, where the stored strip section is cut into pieces by means of the cutting device.

The pieces produced in steps c) and d) are preferably discharged into a collecting space. The above steps a) to d) are preferably carried out in the stated chronological order. In the above step c), strip sections may be cut to a length in the direction of feed of between 0.1 m and 5 m.

The apparatus for producing a metal strip in a continuous casting and rolling process, comprising a casting machine and a finishing rolling mill situated downstream in the direction of feed of the strip, is characterized according to the invention in that a cutting device is provided between the casting machine and the finishing rolling mill, and in that a strip store for receiving a strip section is provided downstream of the cutting device in the direction of feed, wherein downstream of the cutting device and upstream of the strip store in the direction of feed, a driver is provided, which is embodied for feeding the strip into the strip store.

Preferably, the driver is also designed to feed the strip back to the cutting device.

The cutting device is preferably a rotary shear. However, a pendulum shear or a movable gate shear may also be used.

A collecting space for strip pieces is preferably provided below the cutting device. A scrap chute may be arranged between the cutting device and the collecting space.

An additional driver may be provided upstream of the cutting device in the direction of feed.

A furnace may also be arranged upstream of the cutting device in the direction of feed.

This concept may be applied to any mill configuration comprising any combination of casting machine, roughing mill, furnace, intermediate rolling mill and finishing rolling mill The invention provides in particular that a chopping shear combined with a strip store is used. If a malfunction or an emergency stop occurs, or even during a planned interruption in operations, for example due to a roll change in the finishing train, the strip arriving from the casting machine is temporarily stored in the strip store. A rotary shear preferably cuts through the strip. A driver downstream of the cutting device feeds the strip into the strip store. This results in a short gap. The cutting device cuts the incoming strip into scrap pieces, which preferably slide down a scrap chute into a scrap disposal area.

A cutting device downstream of the casting machine severs the strand. The remaining strip is accelerated, and the cutting device (rotary shear) cuts it into pieces. The strand that is then being cast is cut into sheets by means of the cutting device downstream of the casting machine, and is pushed off by a discharge device.

The jam in the finishing train is removed, for example disposed of manually. The strip between the finishing rolling mill and the cutting device (rotary shear) can then be moved backwards (i.e., opposite the direction of feed) out of the strip store and through the cutting device, which cuts it into pieces.

Once this is finished, the casting machine and the entire mill can return to normal operation.

The scrap pieces can be returned directly to the melting process. The area between the rotary shear and the finishing train can be cleared backwards. The proposed configuration is compact and can be operated energy efficiently. The strip store may also be used for tension control.

A rotary shear can dispose of the scrap quickly and efficiently.

BRIEF DESCRIPTION OF THE DRAWINGS

The set of drawings illustrates one embodiment of the invention. The drawings show.

DETAILED DESCRIPTION OF THE INVENTION

Figure 1:
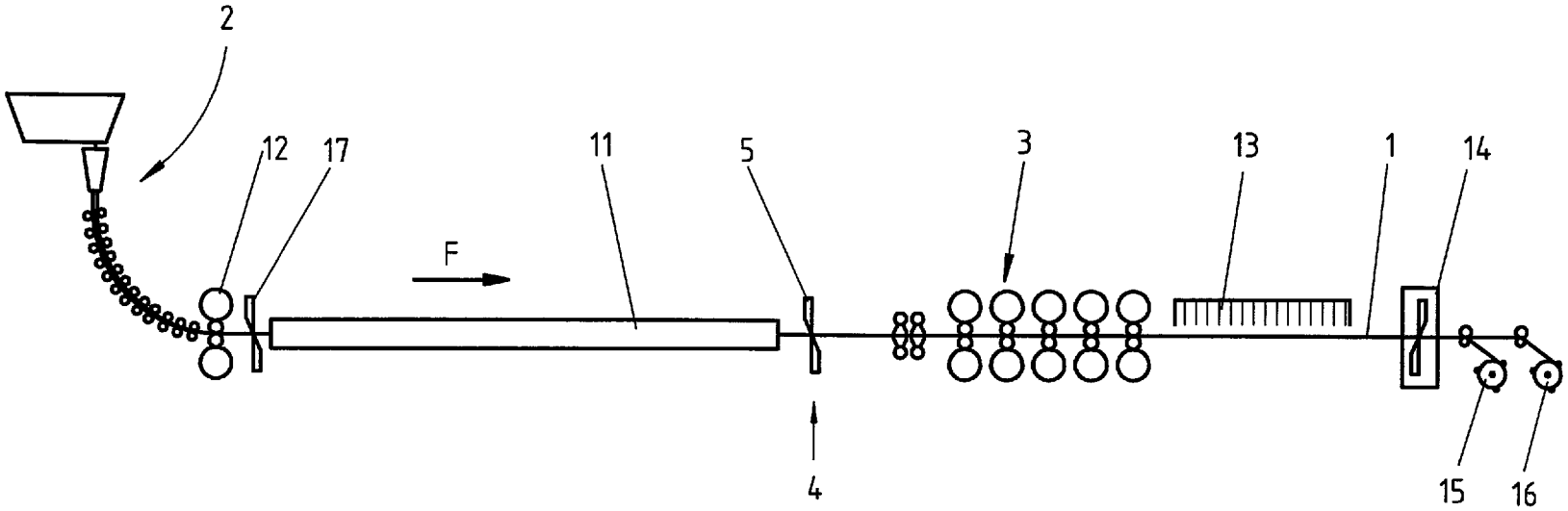
FIG. 1 a schematic illustration of a continuous casting and rolling mill for producing a steel strip and FIG. 2 an enlarged view of a cutting device in the form of a shear, which is situated between the casting machine and the finishing rolling mill in the system.

FIG. 1 is a diagram of an example of a continuous casting and rolling mill, configured as a fully continuous mill and comprising as its central elements a casting machine 2 and a finishing rolling mill 3 Downstream of casting machine 2 a roughing mill 12 is provided, to which—depending on the system configuration—a furnace 11 (connecting roller table with heating function) is attached. Downstream of furnace 11 is finishing rolling mill 3 Downstream of finishing rolling mill 3 are a cooling zone 13 and a cutting device in the form of a flying shear 14. This is followed by at least one reel 15 and 16 in direction of feed F.

Between roughing mill 12 and furnace 11, a cutting device in the form of a shear 17 for strip 1 is provided. An additional shear 5 (cutting device) is located between furnace 11 and finishing rolling mill 3 at a point 4. Finally, the additional shear (cutting device) 14 is located downstream of cooling zone 13 and upstream of reels 15, 16. FIG. 1 shows an additional shear (cutting device) 17 situated downstream of casting machine 2 and furnace 11.

Figure 2:
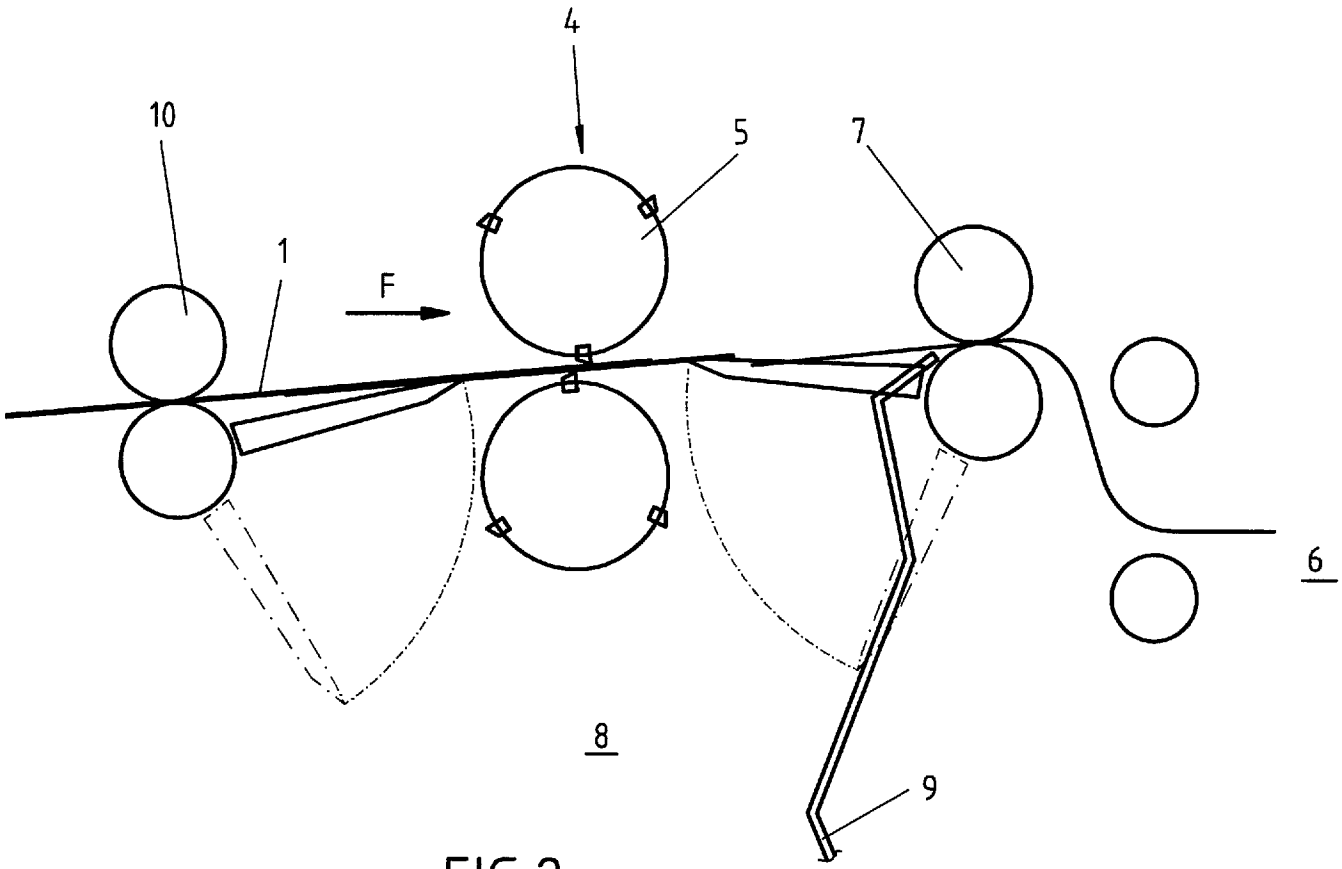

At point 4—as mentioned above—the additional cutting device (shear) 5 is provided, which is detailed more closely in FIG. 2. As the part of the system illustrated in FIG. 2 further shows, a strip store 6, indicated only schematically, is located downstream of cutting device 5 in direction of feed F. Strip 1 emerging from furnace 11 is conveyed by means of a driver 10. Strip 1 can be severed or cut through by means of cutting device 5, which is optionally embodied as a rotary shear. A further driver 7 can then feed the severed strip 1 into strip store 6.

As was described above, in the event of a production interruption in finishing rolling mill 3, strip 1 is cut through at point 4 by cutting device 5. The part of strip 1 that is located downstream of cutting device 5 in direction of feed F is then fed into strip store 6 by means of driver 7. Once strip 1 has been severed or cut through a second time by means of cutting device 5, the strip section following it from casting machine 2 can be cut into pieces. The strip is cut into pieces, preferably of a defined length, in a known manner (see EP 2 259 886 B1 in this regard), and is discharged into a collecting space 8 via a scrap chute 9.

Once this process is complete, the strip 1 that is being held in strip store 6 is fed back in the direction opposite direction of feed F by means of driver 7 to cutting device 5, cut into pieces by cutting device 5, and likewise discharged into collecting space 8.

Of course, the proposed method may also be used in a continuous casting and rolling mill having a different system configuration.

LIST OF REFERENCE SIGNS

1 strip
2 casting machine
3 finishing rolling mill
4 point
5 cutting device (shear)
6 strip store
7 driver
8 collecting space
9 scrap chute
10 driver
11 furnace
12 roughing mill
13 cooling zone
14 cutting device (flying shear)
15 reel
16 reel
17 cutting device (shear)
F direction of feed

The invention claimed is:

1. A method for producing a metal strip (1) in a continuous casting and rolling process, in which a slab is first cast in a casting machine (2) and is then fed to a finishing rolling mill (3) situated downstream in the direction of feed (F) of the strip (1), where it is rolled, the method comprising:

a planned or unplanned production interruption occurs in the finishing rolling mill (3) and the following steps are performed:

a) cutting through the strip (1) at a point (4) between the casting machine (2) and the finishing rolling mill (3) by means of a cutting device (5);

b) feeding the first strip section of the strip (1) that is downstream of the cut in the direction of feed (F) into a strip store (6) by means of a driver (7), the driver (7) being situated downstream of the cutting device (5) in the direction of feed (F);

c) cutting through the strip (1) a second time by means of the cutting device (5), and cutting an adjacent part of the strip (1) into pieces, preferably of a defined length, by means of the cutting device (5); and d) cutting the first strip section into pieces, of a defined length, wherein the first strip section located in the strip store (6) is fed back by means of the driver (7) in the direction opposite the direction of feed (F) to the cutting device (5), wherein the first strip section is cut into pieces by means of the cutting device (5).

2. The method according to claim 1, wherein in step c) the pieces are discharged into a collecting space (8).

3. The method according to claim 1, wherein step d), the pieces are discharged into a collecting space (8).

4. The method according to claim 1, wherein steps a) to d) of claim 1 are carried out in the stated chronological order.

5. The method according claim 1, wherein in step c) of claim 1, strip sections are cut to a length in the direction of feed (F) of between 0.1 m and 5 m.

6. An apparatus for producing a metal strip (1) in a continuous casting and rolling process, comprising a casting machine (2) and a finishing rolling mill (3), situated downstream thereof in the direction of feed (F) of the strip (1), for carrying out the method according to claim 1, wherein a cutting device (5) is provided between the casting machine (2) and the finishing rolling mill (3), and in that a strip store (6) for receiving a strip section is provided downstream of the cutting device (5) in the direction of feed (F), wherein downstream of the cutting device (5) and upstream of the strip store (6) in the direction of feed (F) a driver (7) is located, which is designed to feed the strip (1) into the strip store (6), wherein the driver (7) is also designed to feed the strip (1) back to the cutting device (5).

7. The apparatus according to claim 6, wherein the cutting device (5) is a rotary shear.

8. The apparatus according to claim 6, wherein the cutting device (5) is a pendulum shear or a movable gate shear.

9. The apparatus according claim 6, wherein a collecting space (8) for strip pieces is provided below the cutting device (5).

10. The apparatus according to claim 9, wherein a scrap chute (9) is provided between the cutting device (5) and the collecting space (8).

11. The apparatus according to claim 6, wherein an additional driver (10) is provided upstream of the cutting device (5) in the direction of feed (F).

12. The apparatus according to claim 6, wherein a furnace (11) is provided upstream of the cutting device (5) in the direction of feed (F).

* * * * *